US005381938A

United States Patent [19]

Vasudeva

[11] Patent Number: 5,381,938

[45] Date of Patent: Jan. 17, 1995

[54] CLOTHES HANGER WITH IDENTIFICATION COMPARTMENT

[75] Inventor: Kailash C. Vasudeva, Waterloo, Canada

[73] Assignee: Shivtech Plastics Inc., Waterloo, Canada

[21] Appl. No.: 196,498

[22] Filed: Feb. 15, 1994

[51] Int. Cl.[6] ..... A47G 25/14

[52] U.S. Cl. ..... 223/85; 40/322

[58] Field of Search ..... 223/85, 88, 92, 95; 40/653, 642, 322, 158.1; 206/281; D6/315

[56] References Cited

U.S. PATENT DOCUMENTS

| | | | |
|---|---|---|---|
| 1,348,952 | 8/1920 | Landey | 40/322 |
| 1,710,296 | 4/1929 | Clark | 40/322 |
| 2,801,036 | 7/1957 | Klein | 40/322 |
| 3,178,842 | 4/1965 | Zimmerman | 40/642 |
| 4,922,639 | 5/1990 | Rehrig | 40/642 |
| 4,937,963 | 7/1990 | Barnes | 40/642 |
| 5,056,248 | 10/1991 | Blanchard | 40/322 |
| 5,238,159 | 8/1993 | Zuckerman | 223/85 |

*Primary Examiner*—Clifford D. Crowder
*Assistant Examiner*—Bibhu Mohanty
*Attorney, Agent, or Firm*—R. Craig Armstrong

[57] ABSTRACT

A clothes hanger constructed of plastic has an integral identification compartment formed by a tag frame. A hook section adapted to support the hanger in use is connected to one side of the tag frame. A pair of arms for supporting clothing are also integrally connected to the tag frame, each arm extending from the frame at an equal distance from where the hook section is connected. The outer ends of the arms are connected by a cross-member. A cover, connected by an integral hinge to the tag frame, has a series of peripheral projections each fitting into a slot on one side of the tag frame to hold the cover against that side of the frame. An identification tag is positionable between the tag frame and the cover such that information on the tag is visible in the window of the frame. The hanger may be utilized by an individual wishing to more easily identify his/her clothing, or by an institution wishing to reduce the number of hangers removed from its premises.

11 Claims, 2 Drawing Sheets

CLOTHES HANGER WITH IDENTIFICATION COMPARTMENT

TECHNICAL FIELD

The invention relates to a clothes hanger, and more particularly, to a plastic clothes hanger having an identification compartment.

BACKGROUND ART

The clothes hanger of this invention has application to situations in which hangers need to be identified with a particular individual or institution. For instance, it is helpful for small children to have hangers that are easily differentiated from those of other small children in school surroundings. It would be an advantage to a hotel or similar institution to have its hangers carry identification to reduce removal by patrons. Although some institutions have identification tags on their hangers already, those tags often take the form of a permanent embossed symbol that is not easily modified; in contrast, the hanger of this invention allow easy and rapid modification of an identification tag carried on it.

The hanger of this invention has the further advantage that it allows an identification tag to be prominently displayed intermediate of a hook section used for mounting the hanger and the hanger's clothing support surfaces. As such the identification tag remains visible when the hanger is in use. A further advantage of the hanger of the invention is that the portion adapted to carry the identification tag contributes to the attractiveness of the hanger even if no identification tag is mounted.

DISCLOSURE OF INVENTION

In one form, the invention is a plastic clothes hanger comprises a hook section, an identification tag frame integrally connected to the hook section, and a pair of support arms with first ends integrally connected to the tag frame. It further comprises a cross-member integrally connected to the second ends of the support arms, and an identification tag frame cover connected by an integral hinge to the tag frame. The first end of each support arm is connected to the tag frame at an equal distance from where the hook section is connected to the tag frame. The tag frame cover has the same general shape as the tag frame, and extends in a first position intermediate the tag frame and the cross-member. The cover has one or more projections each adapted to fit into a complementary slot on one side of the tag frame for holding the cover in a second position against the one side of the tag frame. An identification tag is adapted to be retained between the cover and the tag frame when the cover is in the second position.

The identification tag frame may have either a generally circular, rectangular or square shape. It might alternately have any other convenient shape; for instance, a triangular shape. The hook section, the support arms and the cross-member normally have a generally circular cross-section, although another cross-section might be utilized. All parts of the plastic clothes hanger of the invention normally extend in the same plane.

BRIEF DESCRIPTION OF DRAWINGS

The invention will next be described by means of preferred embodiments, utilizing the accompanying drawings in which.

BEST MODE FOR CARRYING OUT THE INVENTION

Figure 1:
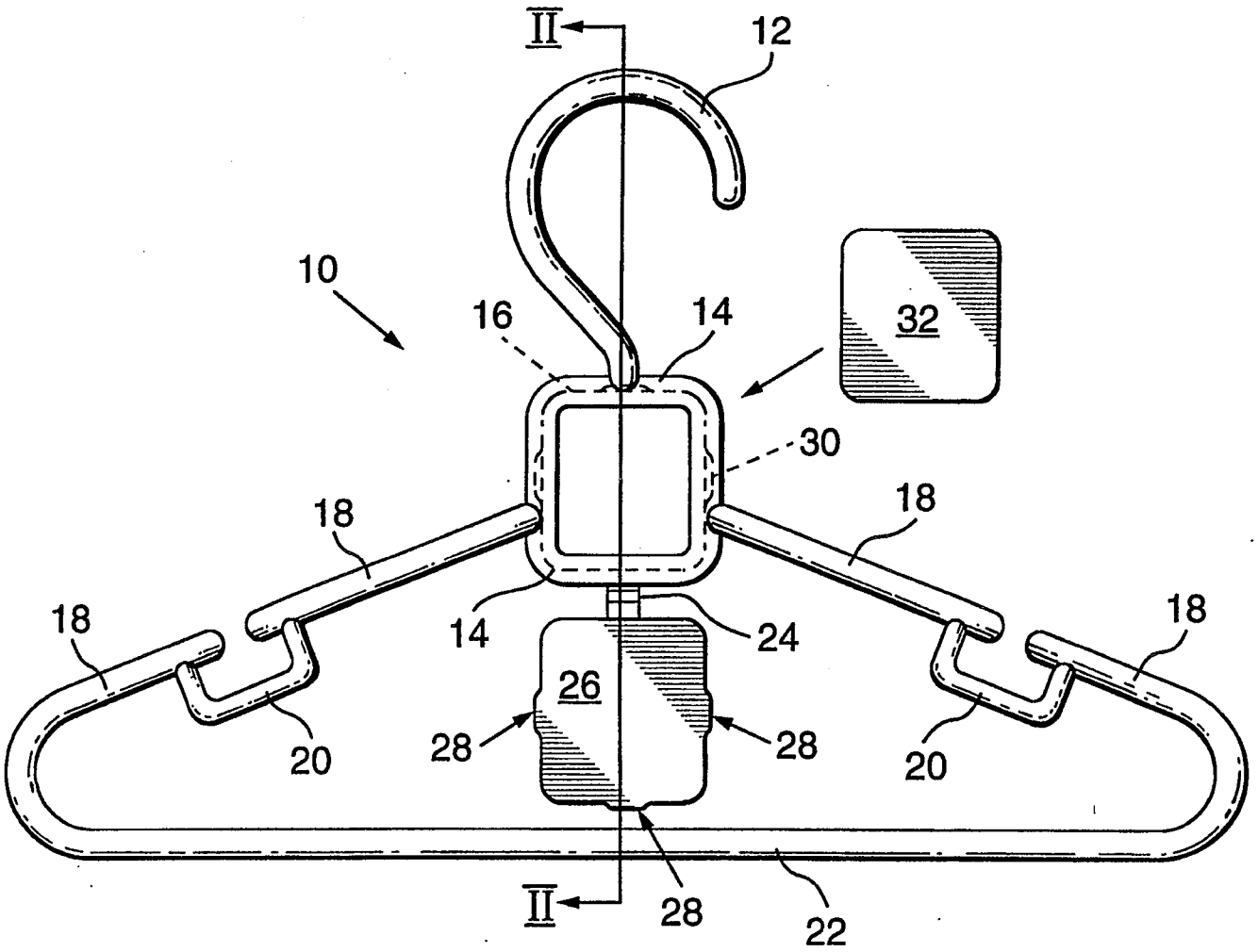
FIG. 1 is a side view of a first embodiment of the clothes hanger of the invention.
Figure 2:
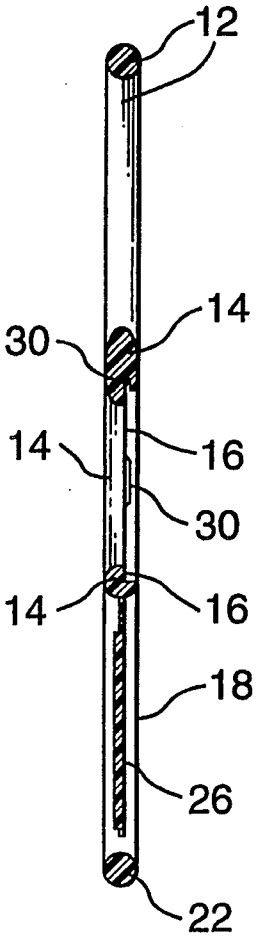
FIG. 2 is a partially-sectioned end view of the hanger of FIG. 1, the view being taken along the line II—II in FIG. 1.

With reference to FIG. 1, a clothes hanger constructed from plastic is generally designated as 10. Hanger 10 has a hook section 12 of generally circular cross-section, integrally connected to one side of an identification tag frame 14 of generally square profile. Hook section 12 and tag frame 14 extend in the same plane. As shown in FIG. 2, tag frame 14 has a cross-section extending approximately three-quarters of a circular arc. The other quarter of the arc defines a ledge 16 extending around the inner periphery of tag frame 14 on one side of that frame.

Integrally connected to respective opposite sides of tag frame 14 at an equal distance from the connection point of hook section 12 are a pair of support arms 18, each of circular cross-section. The support arms 18 each have an intermediate connecting link 20 inserted to capture the respective strap of a nightgown or similar clothing mounted on hanger 10. A cross-member 22, also of circular cross-section, has its outer ends integrally connected by arcuate arches to the outer ends of support arms 18.

Figure 3:
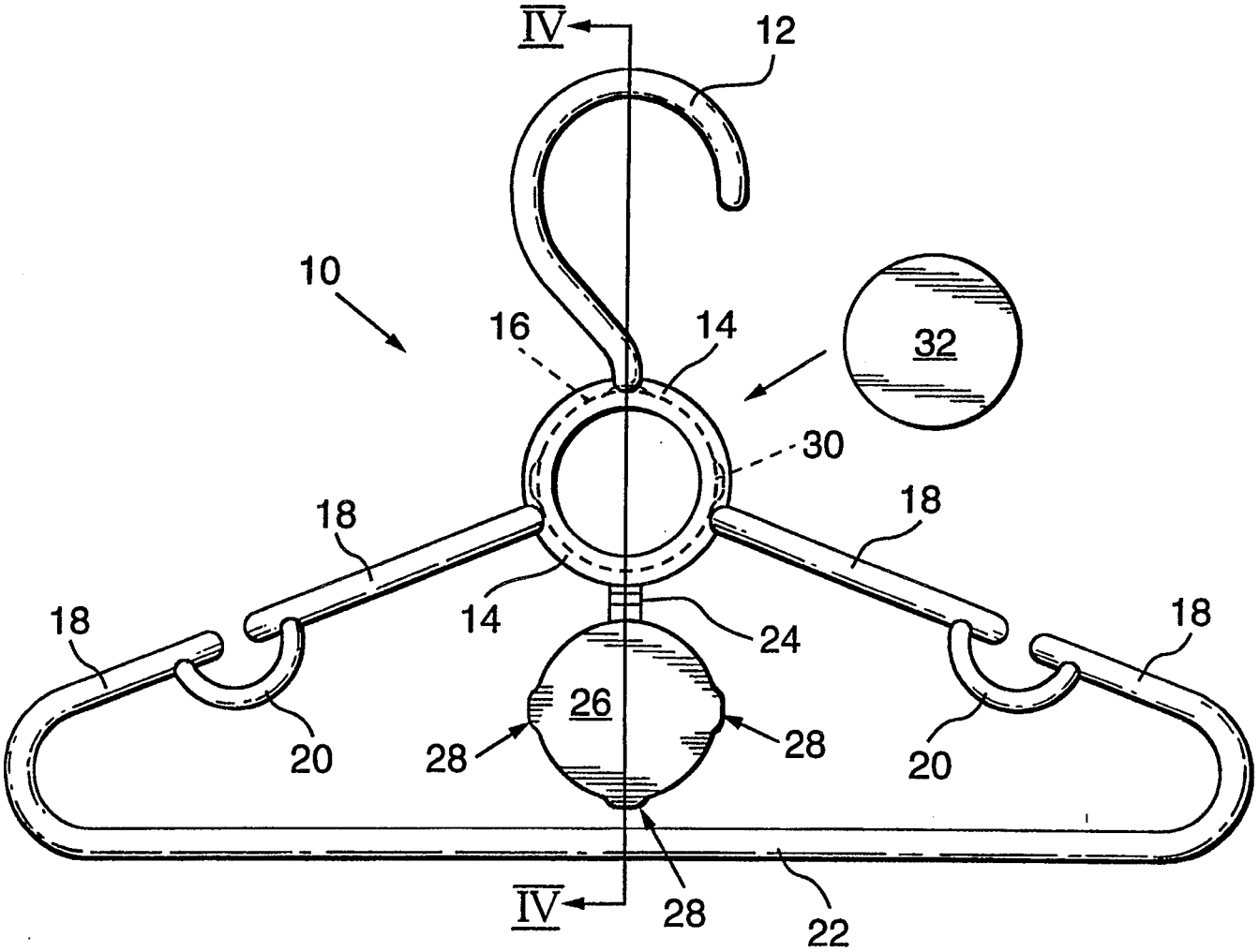
FIG. 3 is a side view of a second embodiment of the clothes hanger of the invention.

Tag frame 14 has one end of a thin pleated hinge 24 integrally connected to it at a point approximately opposite to the point at which hook section 12 is connected. A tag frame cover 26 is integrally connected by a first one of its sides to the other end of hinge 24. The outer profile of cover 26 approximately matches in size and shape the outer profile of ledge 16 on tag frame 14. On each of the other three sides of cover 26 a projection 28 extends, as best seen in FIG. 3. Each projection 28 is adapted to fit into a complementary slot 30 on the periphery of ledge 16 when cover 26 is pressed against that side of tag frame 14 having ledge 16.

An identification tag 32 having a similar profile to, but slightly smaller size than, cover 26 is adapted to be positioned on the ledge 16 before cover 26 is pressed into the side of tag frame 14. A knife or other sharp-edged instrument may be used to pry cover 26 away from tag frame 14 if identification tag 32 needs to be replaced or modified.

Figure 4:
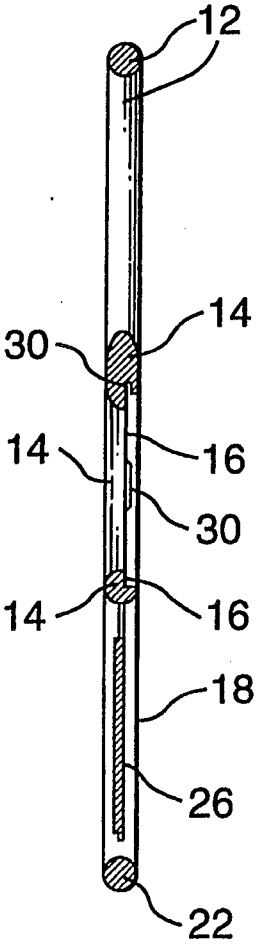
FIG. 4 is a partially-sectioned end view of the hanger of FIG. 3, the view being taken along the line IV—IV in FIG. 3.

FIGS. 3 and 4 are views of a hanger identical to the hanger of FIGS. 1 and 2, except for the circular profile of tag frame 14 and cover 26. Alternate matching profiles are possible for those two members, for instance, a rectangular profile or a triangular profile.

Although not shown in the drawings, it is possible that the cover 26 could take the form of a ring with a window in its centre. This arrangement would allow use of an identification tag with printing on both sides, a hanger with such tag being identifiable from either side.

INDUSTRIAL APPLICABILITY

The plastic clothes hanger of the invention has an integral compartment for housing a replaceable identification tag, reducing loss or misplacement of the hanger.

What is claimed as the invention is:

1. A plastic clothes hanger comprising:
(a) a hook section;
(b) an identification tag frame integrally connected to the hook section;
(c) a pair of support arms, each having a first end integrally connected to the tag frame at an equal distance from where the hook section is connected to the tag frame;
(d) a cross-member having a pair of ends, each end being integrally connected to a second end of a respective one of the pair of support arms; and,
(e) an identification tag frame cover connected by an integral hinge to the tag frame and having the same general outer shape as the tag frame, the cover extending in a first position intermediate the tag frame and the cross-member, the cover having one or more projections each adapted to fit into a complementary slot on one side of the tag frame for holding the cover in a second position against the one side of the tag frame, an identification tag being adapted to be retained between the cover and the tag frame when the cover is in the second position.

2. A plastic clothes hanger as in claim 1, wherein the identification tag frame and cover have a generally circular shape.

3. A plastic clothes hanger as in claim 1, wherein the identification tag frame and cover have a generally rectangular shape.

4. A plastic clothes hanger as in claim 1, wherein the identification tag frame and cover have a generally square shape.

5. A plastic clothes hanger as in claim 1, wherein the hook section, the support arms and the cross-member each have a generally circular cross-section.

6. A plastic clothes hanger as in claim 1, wherein the hook section, the support arms, the identification tag frame and the cross-member all extend in the same plane.

7. A plastic clothes hanger comprising:
(a) a frame adapted to hold an identification tag, the frame being a planar loop having a generally uniform cross-section, the inner periphery of the loop being configured such that a ledge exists on one side of the loop, the plane of the ledge being parallel to the plane of the loop;
(b) a hook section integrally connected to the outside of the frame and extending in the plane of the frame;
(c) a pair of support arms, each having a first end integrally connected to the outside of the frame at an equal distance from where the hook section is connected to the frame, the support arms extending in the plane of the frame;
(d) a cross-member having a pair of ends, each end being integrally connected to a second end of a respective one of the pair of support arms; and,
(e) a frame cover connected by an integral hinge to the frame intermediate where the pair of support arms are connected to the frame, the cover having the same general outer shape as the frame and extending in a first position intermediate the frame and the cross-member, the cover having one or more projections each adapted to fit into a complementary slot on the inside of the ledge on the frame for holding the cover in a second position against the ledge, an identification tag being adapted to be retained between the cover and the frame when the cover is in the second position.

8. A plastic clothes hanger as in claim 7, wherein the frame and cover have a generally circular shape.

9. A plastic clothes hanger as in claim 7, wherein the frame and cover have a generally rectangular shape.

10. A plastic clothes hanger as in claim 7, wherein the frame and cover have a generally square shape.

11. A plastic clothes hanger as in claim 7, wherein the hook section, the support arms and the cross-member each have a generally circular cross-section.

* * * * *